US009190227B2

(12) United States Patent
Kato

(10) Patent No.: US 9,190,227 B2
(45) Date of Patent: Nov. 17, 2015

(54) PUSH SWITCH

(71) Applicant: SMK Corporation, Tokyo (JP)

(72) Inventor: Yuichi Kato, Tokyo (JP)

(73) Assignee: SMK Corporation, Tokyo (JP)

( * ) Notice: Subject to any disclaimer, the term of this patent is extended or adjusted under 35 U.S.C. 154(b) by 57 days.

(21) Appl. No.: 14/094,196

(22) Filed: Dec. 2, 2013

(65) Prior Publication Data

US 2014/0158512 A1 Jun. 12, 2014

(30) Foreign Application Priority Data

Dec. 10, 2012 (JP) ..... 2012-286044

(51) Int. Cl.

| | |
|---|---|
| ***H01H 13/14*** | (2006.01) |
| ***G05G 1/02*** | (2006.01) |
| ***H01H 13/705*** | (2006.01) |

(52) U.S. Cl.

CPC ..... *H01H 13/14* (2013.01); *G05G 1/02* (2013.01); *H01H 13/705* (2013.01); *H01H 2217/01* (2013.01); *H01H 2221/026* (2013.01); *H01H 2221/058* (2013.01)

(58) Field of Classification Search

CPC ..... H01H 13/14; H01H 2221/058; H01H 2217/01; H01H 2221/026; H01H 13/705; G05G 1/02

USPC ..... 200/534–535, 344–345, 518–519

See application file for complete search history.

(56) References Cited

U.S. PATENT DOCUMENTS

| | | | | |
|---|---|---|---|---|
| 5,345,051 | A * | 9/1994 | Miike | 200/345 |
| 5,545,866 | A * | 8/1996 | Bulin et al. | 200/345 |
| 5,895,901 | A * | 4/1999 | Watanabe et al. | 200/534 |
| 6,271,487 | B1 * | 8/2001 | Domzalski et al. | 200/1 B |
| 2009/0107821 | A1 | 4/2009 | Ono | |

FOREIGN PATENT DOCUMENTS

| | | | |
|---|---|---|---|
| DE | 102006012649 | A1 | 9/2007 |
| JP | 2007323967 | A | 12/2007 |
| JP | 2011108429 | A | 6/2011 |

OTHER PUBLICATIONS

European Search Report dated May 8, 2014 from corresponding European Application No. EP 2013000572.

* cited by examiner

*Primary Examiner* — Edwin A. Leon

(74) *Attorney, Agent, or Firm* — Locke Lord LLP

(57) ABSTRACT

Provided is a push/press switch design which allows for a reduced total height profile while maintaining a smooth operation with a large operation stroke by suppressing an extremely large sliding friction when a corner portion of a stem is pressed.

3 Claims, 4 Drawing Sheets

PUSH SWITCH

CROSS REFERENCE SECTION

This application claims priority under to Japanese patent application JP2012-286044 under 35 U.S.C. §119(a) filed on Dec. 10, 2012, which is incorporated by reference herein in its entirety.

BACKGROUND

1. Field of the Invention

The present invention relates to a switch which is operated by a pressing operation, and more particularly to a switch structure capable of smoothly performing a pressing operation with a suitable load at a large operation stroke even when a total height of the switch is small.

2. Description of Related Art

Miniaturization of switches, particularly push/press switches places an ever increasing demand on dimensional requirements (e.g., height requirements, etc.). In turn, such miniaturization affects performance of conventional switches due to minimum required distances between, for example, two contact surfaces, a stroke distance, etc. Accordingly, there remains a need for smaller or miniaturized push/press switches that still maintain integrity of operation.

SUMMARY

The present invention has been made in view of the above-mentioned drawbacks, and it is an object of the present invention to provide a switch structure which can acquire a smooth operation of a stem in the vertical direction and the smooth changeover of a switch when a push manipulation is performed by ensuring the sliding between a slide projecting portion and an opening portion and by ensuring a large operation stroke even when a total height of the push switch is lowered.

To overcome the conventional drawbacks, according to a first aspect of the present invention, there is provided a push/press switch, which includes: a casing which has: a first opening portion having a bottom surface on which a center electrode and a side electrode positioned outside the center electrode are formed, and a plurality of second opening portions which are positioned around the first opening portion; a switch mechanism which changes over the electrical conduction between the center electrode and the side electrode; and a stem which includes: a ceiling surface which covers the first opening portion, and a plurality of slide projecting portions which are mounted on the ceiling surface in an erected manner substantially perpendicular to the ceiling surface in a state where the slide projecting portions are slidable into the second opening portions, wherein a third opening portion having a side surface which is continuously formed with a projecting portion slide surface of the slide projecting portion on a first opening portion side is formed on a proximal end of the slide projecting portion on a first opening portion side, a stopper bottom surface formed with a step to the bottom surface is formed between the first opening portion and the second opening portion, a plurality of convex auxiliary slide ribs are mounted on the stopper bottom surface in an erected manner at positions facing the third opening portion in an opposed manner, second-opening-portion-side side surfaces of the auxiliary slide ribs are formed coplanar with first-opening-portion-side side surfaces of the second opening portions, and the slide projecting portions and the auxiliary slide ribs have portions which overlap with each other in the direction perpendicular to the erecting direction of the slide projecting portions and the auxiliary slide ribs in a state where an external force is not applied to the stem, and the switch mechanism is brought into an ON state and the auxiliary slide ribs are loosely fitted into the third opening portions when the stem is pushed by the external force.

In the push/press switch according to a second aspect of the present invention having the above-mentioned constitution of the first aspect, the switch mechanism may be constituted of: a contactor made of a conductive thin metal plate which has an outer annular portion placed on the side electrode and a tongue portion extending from the outer annular portion and positioned in a spaced apart manner from the center electrode; and an elastic body where a bottom-side base portion placed on the outer annular portion and a top base portion spaced apart from the tongue portion and having a projecting portion extending toward the center electrode are continuously formed by an inclined portion.

In the push/press switch according to a third aspect of the present invention having the above-mentioned constitution of the first or second aspect, the ceiling surface may have an approximately square shape, the slide projecting portions and the third opening portion may be formed on four corners of the ceiling surface in an erected manner, the casing may have an approximately cubic shape, and the auxiliary slide ribs and the second opening portion may be formed on four corners of the casing.

According to the first aspect of the present invention, the auxiliary slide ribs are formed on the stopper bottom surface of the casing and hence, a range where the slide projecting portions of the stem are slidable with the auxiliary slide ribs in the pushing direction is increased by an amount corresponding to a length of the auxiliary slide ribs in the erecting direction at maximum. Accordingly, a length that the stem is movable in the vertical direction, that is, an operation stroke of the stem become larger than an operation stroke of a conventional push switch which is not provided with auxiliary slide ribs. Further, the third opening portions which allow the loose fitting of the auxiliary slide ribs therein are formed on the stem and hence, the switch device of the present invention can maintain the same profile as conventional push switches.

According to the second aspect of the present invention, a switch mechanism is constituted of: the contactor made of the conductive thin metal plate and the elastic body and hence, the load characteristic of the switch is determined by the elastic body and the electric conduction between the center electrode and the side electrode is established by the contactor made of conductive metal. Accordingly, it is possible to impart variations to the load characteristic, and also the center electrode and the side electrode can be surely brought into contact with each other and hence, the switch can perform the stable changeover with a large operation stroke.

According to the third aspect of the present invention, the slide projecting portions and the third opening portion are formed in an erected manner on four corners of the ceiling surface having an approximately square shape, and the auxiliary slide ribs and the second opening portions are formed on four corners of the casing having an approximately cubic shape. Accordingly, even when an external pushing force is applied to a corner of the ceiling surface, the sliding between the stem and the casing is generated substantially directly below a portion on which a pushing force acts. Accordingly, even in the initial operation where the operation stroke is large, the smooth operation can be acquired without generating a large sliding frictional force.

DETAILED DESCRIPTION

As discussed above, the present disclosure provides a low profile (e.g., reduced height) switch structure that includes a smooth operation of a stem in the vertical direction and a smooth changeover of a switch when a push manipulation is performed. Such a switch structure improves upon conventional switch structures that prove difficult to miniaturize. Notably, as described herein, the terms "push" and "press" are used interchangeably when referring to push/press switches and operation thereof, as is understood by those skilled in the art.

Figure 8:
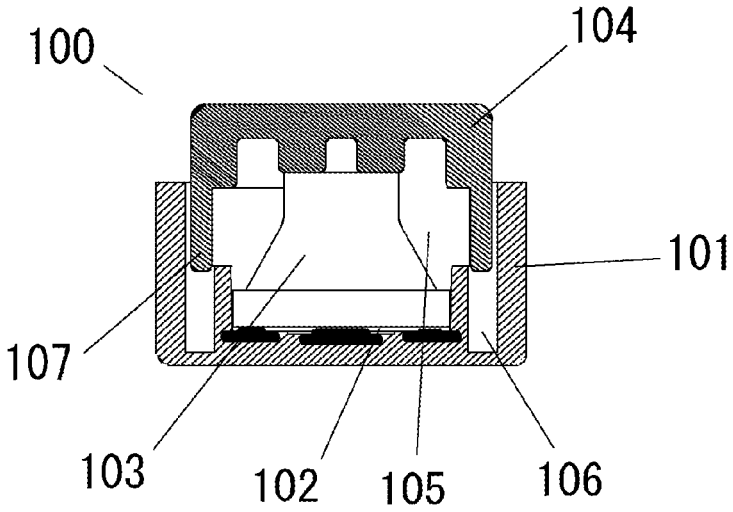
FIG. 8 Prior Art
FIG. 8 is a structural cross-sectional view of a conventional push switch.

With respect to conventional push/press switches, FIG. 8 illustrates a cross section of a conventional push/press switch 100. The conventional push switch 100 includes a casing 101, a contactor 102, an elastic body 103, and a stem 104. The casing 101 opens at one side thereof thus forming a first opening portion 105. A center electrode whose terminal made of conductive metal is exposed is arranged at an approximately center of a bottom surface of the opening portion, and a side electrode whose terminal made of a conductive metal is exposed is arranged around the center electrode on the bottom surface of the opening portion. The center electrode and the side electrode are integrally formed with each other, and one end of each terminal is connected to a printed circuit board (not shown in the drawing) on which the push switch 100 is mounted by soldering or the like. A plurality of second opening portions 106 open in the pushing direction around the first opening portion 105, and slide projecting portions 107 of the stem 104 described later slide through the second opening portions 106.

The contactor 102 which has a tongue extending in the center direction inside a circular ring and is made of a conductive thin metal plate is assembled into the first opening portion of the casing 101, an annular portion of the contactor 102 is placed on the side electrode and a distal end of the tongue portion of the center portion is spaced apart from the center electrode. An approximately conical elastic body 103 made of an elastic insulation material such as rubber is arranged on the circular ring of the contactor 102 in a state where an annular bottom of the elastic body is placed on the circular ring of the contactor. The stem which includes a planar ceiling surface which covers the first opening portion and the second opening portion, a slide projecting portion 107 which projects approximately perpendicularly from the ceiling surface, and is inserted into the second opening portion in a slidable manner, and an engaging member which is engaged with an engaging portion of the casing and projects from an edge portion of the ceiling surface is assembled into the casing by engaging the engaging member with the casing thus assembling the push switch 100.

In the push switch 100 assembled in this manner, when the ceiling surface of the stem 104 is pushed, a top portion of the approximately conical elastic body is pushed so that a convex portion which is formed inside the top portion and projects in the direction toward the bottom surface of the opening portion pushes the tongue of the contactor 102 so that the tongue is brought into contact with the center electrode whereby the center electrode and the side electrode become electrically conductive with each other through the contactor thus bringing the switch into an ON state.

However, recently, this type of push switch 100 has been requested to lower a height thereof to satisfy the recent miniaturization of switches. However, when the height of the switch is lowered, an operation stroke which is a distance that the stem 104 moves in the vertical direction when the stem 104 is pushed and is determined based on a slidable range between the slide projecting portion 107 and the second opening portion 106 becomes small so that it is difficult to acquire a large operation stroke which is a characteristic of the push switch using the elastic body 103.

Hereinafter, an embodiment of the present invention is explained in detail by reference to drawings. FIG. 1 to FIG. 7 illustrate an embodiment of the present invention.

Figure 1:
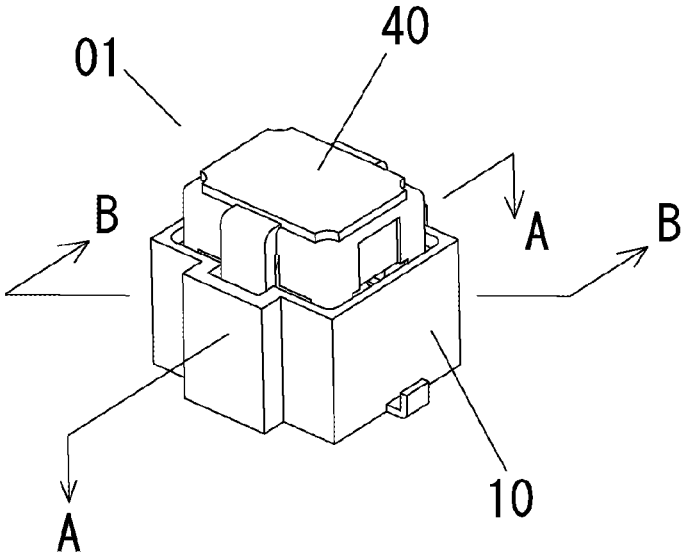
FIG. 1 is a perspective view of a push/press switch according to the present invention.
Figure 2:
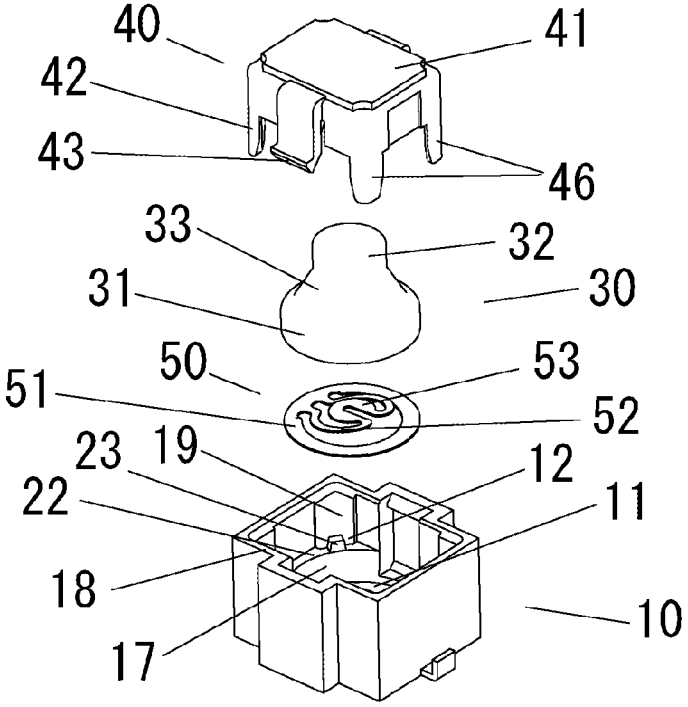
FIG. 2 is a developed perspective view of the push/press switch according to the present invention.
Figure 3:
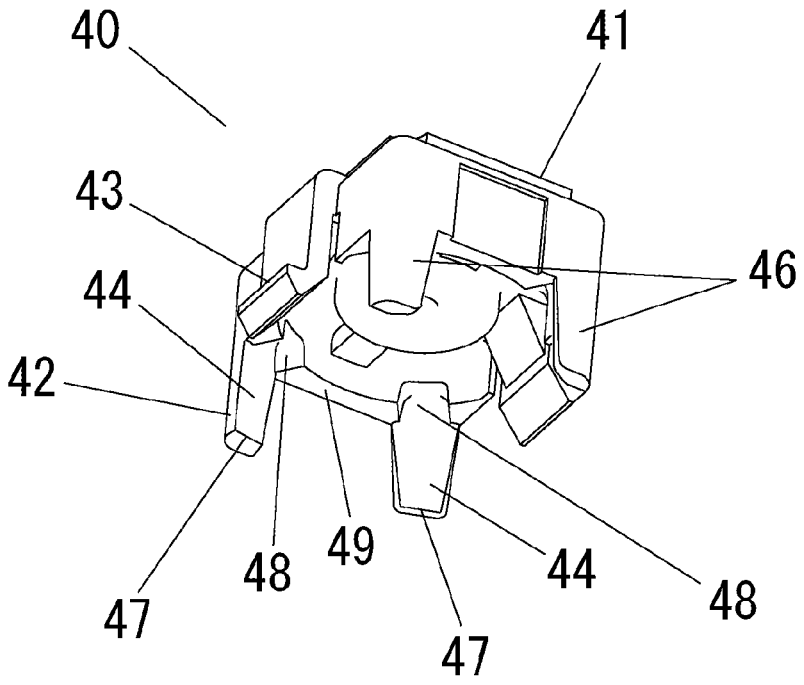
FIG. 3 is a perspective view of a stem of the push/press switch according to the present invention as viewed from a slide projecting portion side.
Figure 4:
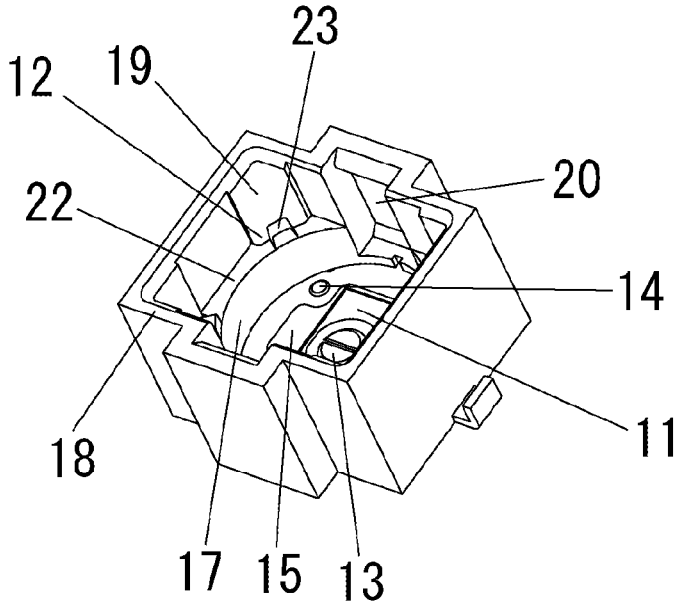
FIG. 4 is a perspective view of a casing of the push/press switch according to the present invention.
Figure 5:
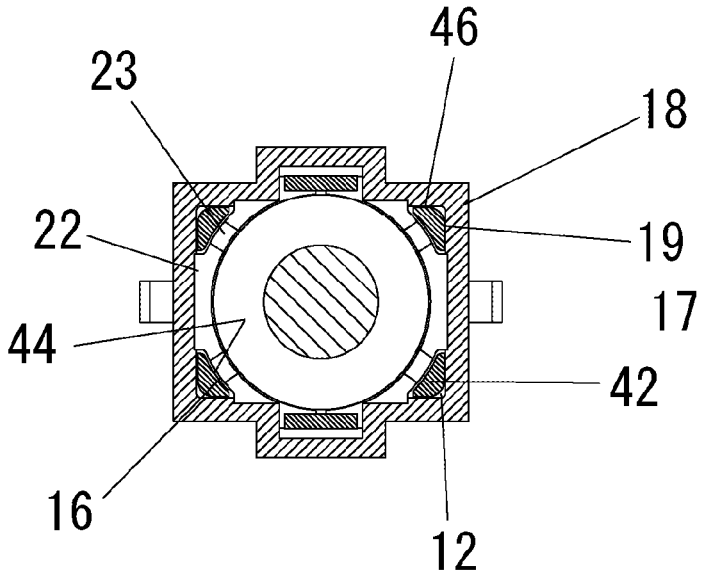
FIG. 5 is a cross-sectional view taken along a line A-A in FIG. 1.
Figure 6:
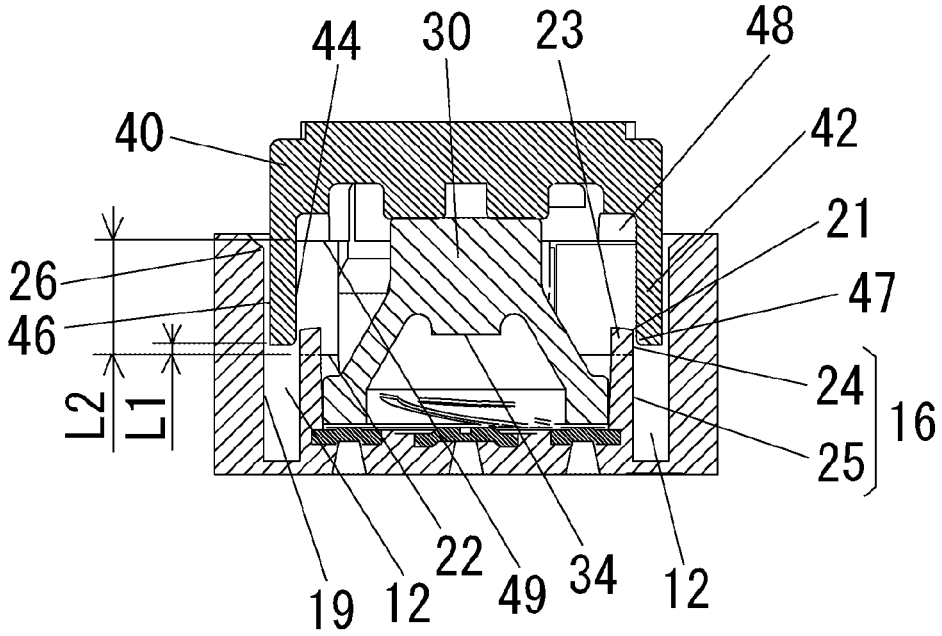
FIG. 6 is a cross-sectional view taken along a line B-B in FIG. 1.
Figure 7:
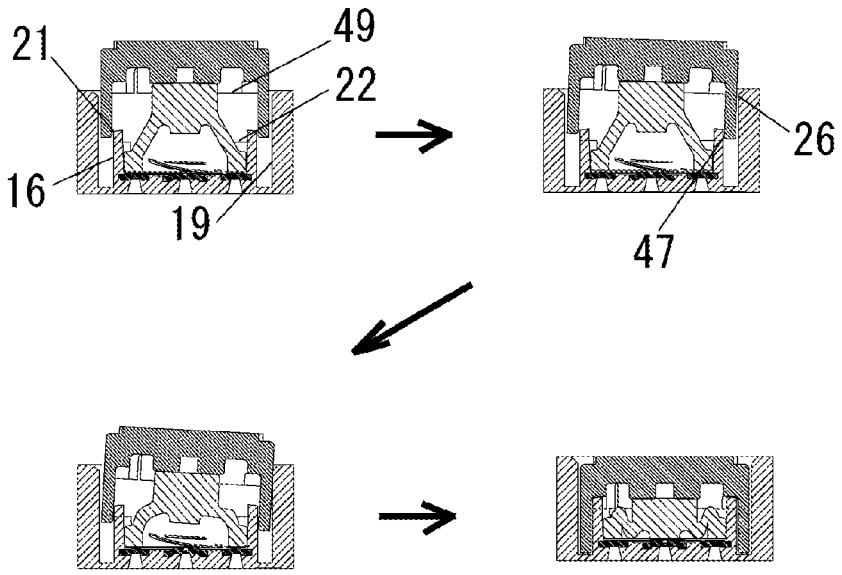
FIG. 7 is a view illustrating an operation state with a part in a cross section taken along a line B-B in FIG. 1.

FIG. 1 is a perspective view of a push switch according to the present invention. FIG. 2 is a developed perspective view of the push switch according to the present invention. FIG. 3 is a perspective view of a stem of the push switch according to the present invention as viewed from a slide projecting portion side. FIG. 4 is a perspective view of a casing of the push switch according to the present invention. FIG. 5 is a cross-sectional view taken along a line A-A in FIG. 1. FIG. 6 is a cross-sectional view taken along a line B-B in FIG. 1. FIG. 7 is a view illustrating an operation state with a part in a cross section taken along a line B-B in FIG. 1. FIG. 8 is a structural cross-sectional view of a conventional push switch.

As illustrated in these drawings, a push switch 01 is constituted of a casing 10 on which a center electrode 13 (ref. FIG. 4) and a side electrode 14 (ref. FIG. 4) are mounted by integral molding, a contactor 50, an elastic body 30 and a stem 40.

The casing 10 is made of an insulation material and has an approximately cubic shape. The casing 10 includes a first opening portion 11 which has an approximately cylindrical shape and a bottom surface 15, and opens at one side. A center electrode 13 which is made of a conductive metal and exposes a surface thereof is arranged on the bottom surface 15 at the approximately center of the bottom surface 15, and a plurality of side electrodes 14 which are also made of a conductive metal are arranged on the bottom surface 15 around the center electrode 13. F Four second opening portions 12 are formed on the periphery of the first opening portion 11 about the center electrode 13 such that the second opening portions 12 are arranged symmetrically at four corners of the casing 10 having an approximately cubic shape for every angle of approximately 90 degrees. The first opening portion 11 and the second opening portion 12 are partitioned by a stopper wall 17 having a step to the bottom surface 15 by one stage.

Auxiliary slide ribs 23 each having a convex rib shape are formed in an erected manner on a stopper bottom surface 22 which constitutes an upper surface of the stopper wall 17 and is formed with a step to a bottom surface 15 by one stage. Side surfaces of the auxiliary slide ribs 23 on a second opening portion 12 side are formed coplanar with opposedly-facing side surfaces 16 of the second opening portions 12 having a curved shape which are positioned on a first opening portion 11 side, and face an inner side surface of the first opening portion 11 in an opposed manner. Assume a portion of the opposedly-facing side surface 16 which constitutes a side surface of the auxiliary slide rib 23 as an auxiliary facing side surface 24, and assume a portion of the opposedly-facing side surface 16 which constitutes a side surface of the second opening portion, that is, a portion which constitutes a side surface of the second opening portion below the stopper bottom surface 22 as a second opening facing side surface 25.

The second opening portions 12 are positioned at four corners of the outer wall of the casing 10 forming a profile of the casing having an approximately cubic shape, and each second opening portion 12 is formed by outer wall side surfaces 19 formed at an angle of approximately 90 degrees, a bottom surface, and the second opening facing side surface 25. As illustrated in FIG. 5 which is a plan view as viewed in the direction indicated by an arrow A in FIG. 1, the second opening portion 12 has an approximately isosceles triangular shape where the opposedly-facing side surface 16 forms the base of the triangular shape. Recessed portions 20 with which the engaging members 43 extending from the stem 40 are engaged are formed on a pair of outer walls of the casing 10 respectively.

The contactor 50 is formed of a thin conductive metal plate, and is constituted of a ring-shaped outer annular portion 51, and a tongue portion 52 which extends toward a center portion from an inner edge of the outer annular portion 51 at a predetermined angle in the thickness direction with respect to the outer annular portion 51. A distal end 53 of the tongue portion 52 is formed in a disc shape, and is positioned at an approximately center portion of the outer annular portion 51.

The elastic body 30 is made of rubber which is an insulation material, and is formed in an approximately conical shape having the hollow inside. The elastic body 30 has a bottom-side base portion 31 and a top base portion 32, wherein the bottom-side base portion 31 is approximately vertically erected and has a thickness larger than a thickness of a conical tapered portion on a bottom side thereof, while the top base portion 32 having a large thickness is formed on a top portion of the elastic body 30. A push projecting portion 34 projects toward the hollow inner portion from the top portion of the elastic body 30.

The stem 40 is made of an insulation material, and is constituted of a ceiling surface 41 having an approximately square shape which covers the first opening portion 11 and the second opening portions 12 of the casing 10, and four slide projecting portions 42 which extend from four corners of the ceiling surface 41. The slide projecting portions 42 are slidably inserted into the second opening portions 12, and each slide projecting portion 42 has an approximately isosceles triangular transverse cross section. In a state where the slide projecting portions 42 are inserted into the second opening portions 12 by assembling as described later, clearances between the slide projecting portion 41 and the second opening portions 12 are set as follows. The clearance between a projecting portion slide surface 44 which constitutes the base of the isosceles triangle and faces the opposedly-facing side surface 16 of the casing 10 and the opposedly-facing side surface 16 and the clearance between the projecting portion outer walls 46 which constitute other two sides of the isosceles triangle and face outer side surfaces 19 of the casing 10 and the outer wall side surfaces 19 are set to fixed values within a range from 0.03 mm to 0.10 mm respectively.

A third opening portion 48 opening in a shape which allows the auxiliary slide rib 23 to be loosely fitted therein is formed on a proximal end of each slide projecting portion 42, and one side surface of the third opening portion 48 is formed continuously and coplanar with the projecting portion slide surface 44.

The push switch 01 is completed by assembling the above-mentioned parts in accordance with steps described hereinafter. Firstly, the contactor 50 is assembled into the first opening portion 11 of the casing 10. In assembling the contactor 50 into the first opening portion 11, the contactor 50 is positioned such that the outer annular portion 51 of the contactor 50 is placed on the side electrodes 14 and the distal end 53 of the tongue portion 52 is spaced apart from the center electrode 13. Then, the elastic body 30 is assembled such that the bottom-side base portion 31 of the elastic body 30 is placed on the outer annular portion 51 of the contactor 50. Due to such assembling, the push projecting portion 34 of the elastic body 30 is positioned in a spaced-apart manner from the distal end 53 of the contactor 50.

In a state where the contactor 50 and the elastic body 30 are arranged in the first opening portion 11 in the manner described above, the stem 40 is assembled to the casing 10 as a last step. Four slide projecting portions 42 of the stem 40 are inserted into the second opening portions 12, and the engaging members 43 of the stem 40 are engaged with the recessed portions 20 of the casing 10 so that the assembly of the push switch 01 is completed. In the assembled state, the push switch is in an initial state where the first opening portion 11 and the second opening portions 12 are covered with the ceiling surface 41 of the stem 40, and the ceiling surface 41 slightly presses the top base portion 32 of the elastic body 30.

When the approximately center of the ceiling surface 41 of the stem 40 of the push switch 01 in such an initial state is pressed, the ceiling surface 41 moves without being inclined and maintaining an approximately horizontal posture thereof so that the top base portion 32 of the elastic body 30 is pressed and hence, the push projecting portion 34 is brought into contact with the distal end 53 of the contactor 50. When the ceiling surface 41 of the stem 40 is further pressed, the distal end 53 is brought into contact with the center electrode 13 so that the center electrode 13 and the side electrodes 14 become electrically conductive with each other via the contactor 50 whereby the push switch is brought into an ON state. Since the elastic body 30 has a conical shape, in the course of such a pushing operation, the conical shape is substantially inverted at a predetermined press stroke so that the pressing operation imparts click feeling to a user.

As a matter of course, when the approximately center of the ceiling surface 41 of the stem 40 is pressed as described above, the ceiling surface 41 is moved without being inclined so that the top base portion 32 of the elastic body 30 is moved by a distance that the ceiling surface 41 is pressed. According to the push switch 01 of this embodiment, even when the corner of the ceiling surface 41 of the stem 40 is pressed, the inclination of the ceiling surface 41 can be minimized regardless of a large operation stroke and hence, it is possible to make an operation state when the corner of the ceiling surface 41 of the stem 40 is pressed approximate an operation state when the center of the ceiling surface 41 is pressed. This operation is explained hereinafter.

When the position of the pushing operation is set at the corner close to the corner portion of the ceiling surface 41 of the stem 40 instead of the center of the ceiling surface 41 of the stem 40, the corner of the ceiling surface 41 is pushed so that the ceiling surface 41 starts to be inclined. Accordingly, the slide projecting portions 42 which extend from the corners of the ceiling surface 41 perpendicular to the ceiling surface 41 also start to be inclined. However, the auxiliary slide ribs 23 are formed on the casing 10 in an erected manner and hence, in an initial stage of the operation, the lowermost portion 47 of the projecting portion slide surface 44 of the slide projecting portion 42 at the position closest to the pushed position is brought into contact with the auxiliary facing side surface 24 of the auxiliary slide rib 23, and the projecting portion outer wall 46 of the slide projecting portion 42 is brought into contact with the outer wall corner portion 26 of the outer wall side surface 19 of the second opening portion 12 which is positioned at the entrance of opening. Accordingly, the inclination of the ceiling surface 41 is suppressed to a slight inclination of a predetermined angle and, at the same time, in the initial stage of the operation, the slide projecting portion 42 slides into the second opening portion 12 substantially directly below the pushed position. Accordingly, the sliding operation is started in a state where a force which is generated between the slide projecting portions 42 and the second opening portions 12 and acts in the horizontal direction perpendicular to a pressing force is small at the lowermost portions 47 and the outer wall corner portions 26, that is, in a state where a friction force generated between the slide projecting portions 42 and the second opening portions 12 are held at a small value.

Accordingly, even when the corner of the ceiling surface 41 is pressed, although there exists the inclination of the ceiling surface 41 at an initial state of the pressing operation, an amount of resistance which the sliding between the slide projecting portion 42 and the second opening portion 12 receives due to a friction force is decreased so that the slide projecting portion 42 smoothly slides into the second opening portion 12. When the pressing operation is continued, the distance by which the slide projecting portion 42 and the second opening portion 12 overlap with each other, that is, the sliding distance is gradually increased. Due to the increase of the sliding distance, the inclination of the ceiling surface 41 is also gradually decreased and, when the distal end 53 of the contactor 50 is brought into contact with the center electrode 13, the operation state becomes substantially equal to the operation state when the center portion of the ceiling surface 41 is pressed so that the push switch 01 is brought into an ON state. When the stem 40 is further operated by a predetermined distance in the pressing direction, the stopper bottom surface 22 is brought into contact with the stopper ceiling surface 49 which is formed on a rear surface of the ceiling surface 41 with a predetermined height from the ceiling surface. The pressing operation is completed by this operation. A moving distance of the stem 40 in the pressing direction from the initial position to the position at which the pressing operation is completed is an operation stroke L2 of the push switch 01.

As described above, in the push switch 01 of this embodiment, the auxiliary slide ribs 23 are formed on the casing 10 and hence, at an initial stage of the pressing operation, the slide projecting portions 42 are brought into contact with and slide on the auxiliary slide ribs 23. Accordingly, compared to a structure where the auxiliary slide ribs 23 are not formed on the casing 10, it is possible to add an operation stroke L1 corresponding to a length of the auxiliary slide ribs 23 in the erecting direction at maximum. Further, the auxiliary slide ribs and the second opening portions 12 are formed at four corners of the casing 10 respectively, and the slide projecting portions 42 and the third opening portions 48 are formed at four corners of the stem 40 respectively. Accordingly, even when the corner of the ceiling surface 41 is pressed, the sliding between the stem 40 and the casing 10 is performed by the slide projecting portion 42, the auxiliary slide rib 23, and the second opening portion 12 which are arranged directly below a portion of the ceiling surface 41 on which the pushing force acts thus realizing a smooth switching operation with a small slide friction. The third opening portions 48 into which the auxiliary slide ribs 23 are loosely fitted is provided and hence, it is possible to increase an operation stroke without increasing a height of the switch 01. The slide mechanism formed of the auxiliary slide ribs 23, the second opening portions 12, the slide projecting portions 42, and the third opening portions 48 is provided at four corners where the slide mechanism does not interfere with the switch mechanism constituted of the elastic body 30, the contactor 50 and the like. Accordingly, it is possible to set a large operation stroke L2 which allows the smooth sliding operation without lowering a strength of the stem 40 or the like, making a shape of the switch 01 in the plane direction large, and increasing the whole size of the switch in conformity with the size in the height direction. Further, the length of the slide projecting portion 42 in the erecting direction is increased and hence, it is possible to provide the structure which prevents troubles including a trouble that when one corner of the ceiling surface 41 is pressed, the slide projecting portion 42 at a corner opposite to the corner is removed from the casing 10 due to the inclination.

Although an approximately square shape is adopted as the shape of the ceiling surface 41 of the stem 40 in this embodiment, the shape of the ceiling surface 41 is not limited to the approximately square shape, and may be a rectangular shape, a triangular shape, a round shape or the like, and a shape of the casing 10 which corresponds to the stem 40 may also be a cubic shape, a triangular columnar shape, a cylindrical shape or the like. The number of slide mechanisms each of which is constituted of the auxiliary slide rib 23, the second opening portion 12, the slide projecting portion 42, and the third opening portion is not limited to four, and the slide mechanism may be formed at two portions, three portions or the like corresponding to the shape of the switch.

What is claimed is:

1. A push/press switch comprising:

a casing including:

a first opening portion having a bottom surface on which a center electrode and a side electrode, positioned outside the center electrode, are formed, and a plurality of second opening portions which are positioned around the first opening portion;

a switch mechanism which changes over the electrical conduction between the center electrode and the side electrode; and a stem including:

a ceiling surface which covers the first opening portion, and a plurality of slide projecting portions which are mounted on the ceiling surface in an erected manner substantially perpendicular to the ceiling surface in a state where the slide projecting portions are slidable into the second opening portions, wherein a third opening portion having a side surface, which is continuously formed with a projecting portion slide surface of the slide projecting portion on a first opening portion side, is formed on a proximal end of the slide projecting portion on the first opening portion side, a stopper bottom surface formed with a step to the bottom surface is formed between the first opening portion and the second opening portion, a plurality of convex auxiliary slide ribs are mounted on the stopper bottom surface in an erected manner at positions facing the third opening portion in an opposed manner, second-opening-portion-side surfaces of the auxiliary slide ribs formed coplanar with first-opening-portion-side surfaces of the second opening portions, the slide projecting portions and the auxiliary slide ribs have portions which overlap with each other in the direction perpendicular to the erecting direction of the slide projecting portions and the auxiliary slide ribs in a state where an external force is not applied to the stem, and the switch mechanism is brought into an ON state, the auxiliary slide ribs are loosely fitted into the third opening portions, and outer walls of the stem is completely placed inside of the casing when the stem is pressed by the external force.

2. The push/press switch according to claim 1, wherein the switch mechanism comprises:

a contactor made of a conductive thin metal plate which has an outer annular portion placed on the side electrode and a tongue portion extending from the outer annular portion and positioned in a spaced-apart manner from the center electrode; and an elastic body where a bottom-side base portion placed on the outer annular portion and a top base portion spaced apart from the tongue portion and having a projecting portion extending toward the center electrode are continuously formed with each other by an inclined portion.

3. The push/press switch according to claim 2, wherein the ceiling surface has an approximately square shape, the slide projecting portions and the third opening portion are formed on four corners of the ceiling surface in an erected manner, the casing has an approximately cubic shape, and the auxiliary slide ribs and the second opening portions are formed on four corners of the casing.

* * * * *